US006964409B2

(12) United States Patent
Appel et al.

(10) Patent No.: US 6,964,409 B2
(45) Date of Patent: Nov. 15, 2005

(54) CHAIN BLOCK

(75) Inventors: Erik Appel, Lichtenfels (DE); Ralf Eising, Herne (DE); Jürgen Heun, Dortmund (DE); Jörg Lindemaier, Dortmund (DE); Oliver Moll, Solingen (DE); Klaus Wissing, Pleisweiler-Oberhofen (DE); Thilo Walloschek, Gevelsberg (DE); Rüdiger Ostholt, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 0 days.

(21) Appl. No.: 10/668,051

(22) Filed: Sep. 22, 2003

(65) Prior Publication Data

US 2004/0149971 A1 Aug. 5, 2004

(30) Foreign Application Priority Data

Sep. 23, 2002 (DE) ..... 102 44 864

(51) Int. Cl.[7] ..... B66D 1/20
(52) U.S. Cl. ..... 254/358
(58) Field of Search ..... 254/358, 372, 254/342, 344, 366

(56) References Cited

U.S. PATENT DOCUMENTS 3,784,165 A * 1/1974 Pruitt ..... 254/342
4,605,111 A * 8/1986 Ohno et al. ..... 192/16
5,170,995 A * 12/1992 Bitsch et al. ..... 254/342

FOREIGN PATENT DOCUMENTS

| | | |
|---|---|---|
| DE | 366641 | 1/1923 |
| DE | 967900 | 12/1957 |
| DE | 2848070 | 5/1980 |
| DE | 8138693 | 10/1986 |
| DE | 29722687 | 2/1998 |
| EP | 758623 | 2/1997 |
| EP | 950632 | 10/1999 |
| FR | 1355145 | 3/1964 |
| GB | 741063 | 11/1955 |

OTHER PUBLICATIONS

European Search Report dated Dec. 17, 2003, from corresponding Patent Application Serial No. EP 03018721.

* cited by examiner

*Primary Examiner*—Emmanuel Marcelo
(74) *Attorney, Agent, or Firm*—Van Dyke, Gardner, Linn & Burkhart, LLP

(57) ABSTRACT

A chain block with a drive motor (2) and with a transmission (3), connected to the drive motor (2) at the take-off side, with a transmission output shaft (4), on which a chain wheel (5) is rigidly arranged for pulling a chain. In order to create a compact chain block, the chain wheel (5) faces the drive motor (2) at its take-off end face (19) and the outer circumference of the chain wheel (5) reaches into the imaginary extension of the outer contour of the drive motor (2).

22 Claims, 2 Drawing Sheets

CHAIN BLOCK

BACKGROUND OF THE INVENTION

The invention concerns a chain block with a drive motor and with a transmission connected to the drive motor at the take-off side, with a transmission output shaft, on which is rigidly arranged a chain wheel for a chain as the means of pulling.

Suspended chain blocks are generally known. These have a drive motor and a secondary transmission, which are joined together by drive engineering. The transmission can have one or more stages, there being present at least two transmission shafts running parallel to each other and separated from each other, in the form of one transmission input shaft and one transmission output shaft. In this case, an input gear of the transmission is arranged on the input shaft and an output gear on the output shaft. In a two-stage transmission, the input gear engages with the driven gear of the first stage, which, in turn, drives the driving gear of the second stage, which engages with the output gear; i.e., the driven gear of the second stage. Furthermore, the chain wheel is rigidly mounted on the transmission output shaft.

The drawback of these familiar chain blocks is that they only have a limited compact construction and usually are not horizontally oriented when suspended from a supporting element.

SUMMARY OF THE INVENTION

The basic purpose of the invention is to create a compact chain block, preferably this chain block should be capable of being suspended horizontally from a support element without additional external measures.

The purpose is achieved by a chain block with the features of claim 1. The dependent claims set forth advantageous embodiments of the chain block.

According to the invention, in a chain block with a drive motor and with a transmission connected to the drive motor at the take-off side, with a transmission output shaft, on which a chain wheel for a chain used as the means of pulling is rigidly arranged, a compact construction is achieved in that the chain wheel faces the drive motor at its take-off end face and the outer circumference of the chain wheel reaches into the imaginary prolongation of the outer contour of the drive motor. Besides a compact construction, this also ensures that the chain pay-out point lies in the region of the center of gravity of the chain block. Thus, the chain block can be suspended from a lug arranged at its top center, without any additional support measures.

In a preferred embodiment, the outer circumference of the chain wheel extends for at least a quarter of the diameter of the chain wheel into the imaginary extension of the outer contour of the drive motor.

In a simple structural embodiment, it is proposed that the drive motor have a motor shaft oriented parallel to the transmission output shaft for the chain wheel.

It is especially advantageous that an installation space be present between the chain wheel and the end face of the drive motor, whose width, being the distance between the chain wheel and the end face, is greater than the width of the chain wheel, so that the chain wheel can be replaced without removing the drive motor.

Despite the existence of the installation space, the structural length of the chain block is optimized in that the end face of the drive motor is closed off from the installation space exclusively by a sleeve of insulating plastic.

When doing a replacement, after loosening a lock washer, the chain wheel is pulled off from the transmission output shaft into the installation space and, from there, removed at the bottom or at the side. This simplifies the maintenance for the chain block.

The suspending of the chain block, which one can also designate a so-called "point block" because of the single chain paid out, can be further simplified and be accomplished without additional means if the pay-out point of the chain from the chain wheel lies at the center of gravity of the chain block. This also advantageously eliminates the need for any additional counterweight. For its suspending, the chain block has a familiar lug on its top side.

In a structurally advantageous and very compact manner, it is specified that the transmission have at least one first gear mounted on a transmission input shaft and at least one additional gear mounted on the transmission output shaft, wherein the transmission input shaft and the transmission output shaft are arranged at a distance from each other and run parallel to each other, and the motor shaft is arranged coaxially to the transmission input shaft. Furthermore, it is specified that the transmission have two stages and, besides the transmission input shaft and the transmission output shaft, it has an additional transmission shaft; the transmission input shaft, the transmission output shaft, and the transmission shaft are arranged in parallel to each other and form a V shape, wherein the transmission output shaft is arranged somewhat above the transmission input shaft and thus the motor shaft. This accomplishes a small structural width.

These and other objects, advantages and features of this invention will become apparent upon review of the following specification in conjunction with the drawings.

BRIEF DESCRIPTION OF THE DRAWINGS

A sample embodiment of the invention will now be described by means of a drawing. This shows.

DETAILED DESCRIPTION OF THE PREFERRED EMBODIMENT

Figure 1:
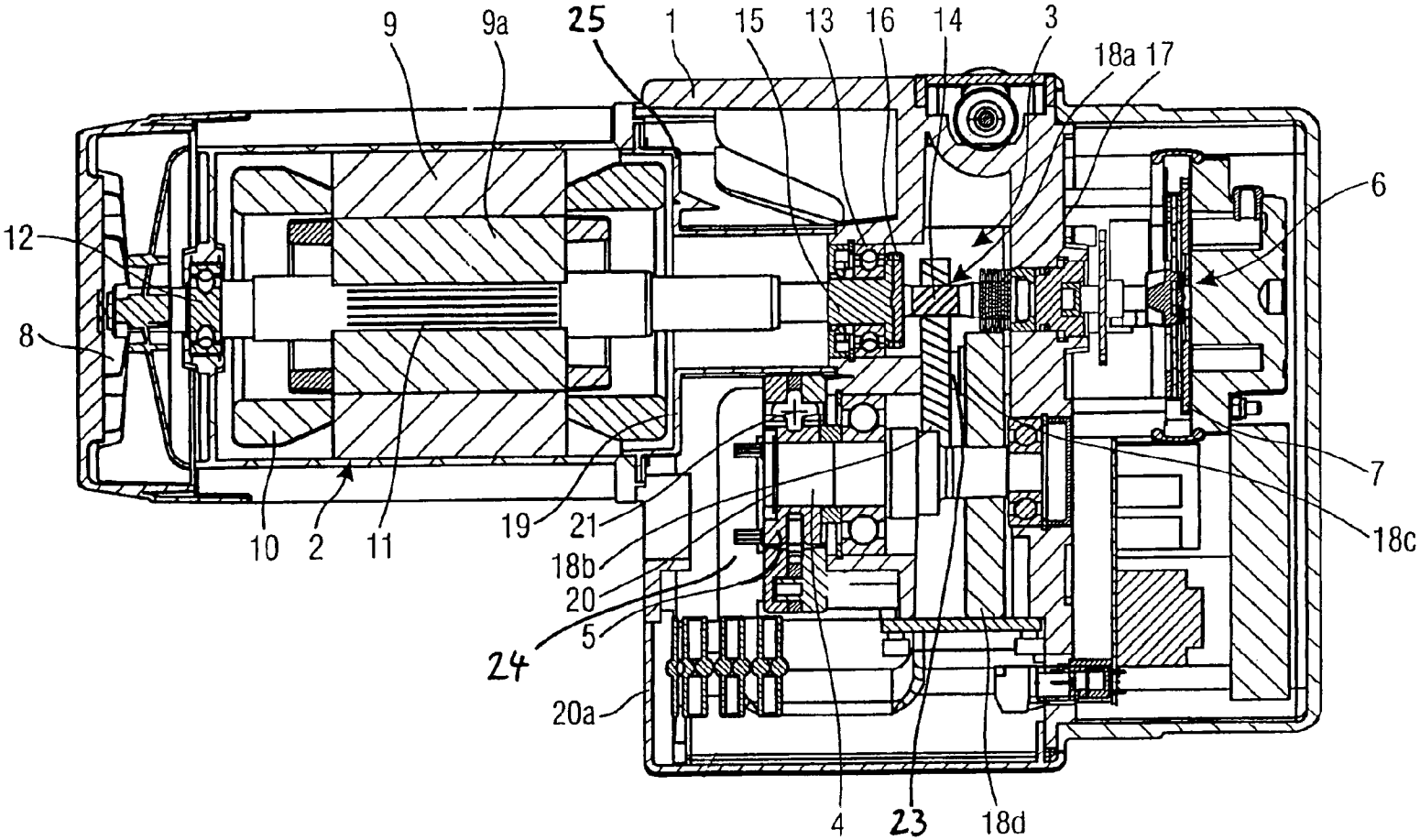
FIG. 1, a lengthwise section through a chain block.

FIG. 1 shows a lengthwise section of a chain block, which is arranged in a housing 1. The chain block comprises, as the drive arrangement, an electric drive motor 2 and a secondary transmission 3 with two transmission stages. On its transmission output shaft 4 is mounted a chain wheel 5 for the chain, rigidly joined to the shaft. The chain block can be suspended by means of a lug (not shown) from a support element (not shown).

A brake 6 with an anchor plate 7 at the take-off end of the drive motor 2 serves to brake the chain block; at the opposite end, a fan 8 is provided for ventilation.

The motor 2 has a stator 9, a rotor 9*a*, a motor winding 10, and a motor shaft 11, which is supported by a first pivot bearing 12 and a second pivot bearing 13, the pivot bearing 13 at the driving side simultaneously supporting the motor shaft 111 and the transmission input shaft 14.

As overload protection, a slip clutch 15 is inserted between motor shaft 11 and transmission input shaft 14, whose clutch disks 16 are represented in FIG. 1. The slip clutch 15 is subjected to a counterforce, which is furnished by flat springs 17 thrusting against the housing 1.

The two-stage transmission 3 has the transmission input shaft 14 at the input side, having a spiral thread to form a first gear 18*a*. The first gear 18*a* engages with a second gear 18*b* with a corresponding spiral thread, which is mounted on a middle transmission shaft 23. On this middle transmission shaft 23 is also arranged the third gear 18*c* of the second transmission stage, which engages with a fourth gear 18*d* rigidly mounted on the transmission output shaft 4 and thus drives the transmission output shaft 4. All three transmission shafts 4, 14 and 23 run parallel to each other and also at a distance from each other.

As FIG. 1 shows, the chain wheel 5 as well as one of the two ends of the transmission output shaft 4 face the end face 19 of the take-off side of the drive motor 2. The distance between the end face 19 and the outer edge of the chain wheel 5, facing this end face 19, is chosen so that an installation space 24 is produced, whose width—in the sense of the distance between the edge of the chain wheel 5 and the end face 19—is greater than the width of the chain wheel 5 being installed or removed. Thus, by simply loosening a lock washer 20 arranged at the end of the transmission output shaft 4 or an axial shaft retaining ring, the chain wheel 5 can be pulled off from the transmission output shaft 4 toward the end face 19 and will then be inside the installation space 24. From this installation space 24, the chain wheel 5 can then be removed sideways, preferably downward, from the housing 1 of the chain block. Thus, it is possible to replace the chain wheel 5 without removing the drive arrangement. It is only necessary to take off a side cover piece 20*a* of the chain block before loosening the chain wheel 5 to gain access to the installation space 24.

A sufficient distance between the chain wheel 5 and the end wall is necessary because—as FIG. 1 shows—the chain wheel 5 reaches into the imaginary prolongation of the outer contour of the drive motor 2, which is essentially determined by the motor windings 10 of the stator 9. The motor windings 10 are surrounded by a motor housing, also in conventional fashion. The chain wheel 5 is shifted so much toward the motor shaft 11 that the pay-out point 21 of the chain lies at the center of gravity of the chain block. In order to preserve the compact construction of the chain block despite the existing installation space 24, the end face 19 of the drive motor 2 is formed by a relatively thin plastic sleeve 25, from which the motor shaft 11 emerges at the center. This sleeve 25 has a purely insulating and no supporting function. Also, the sleeve 25 has a smaller structural mass than the otherwise typical motor cover, which also supports the additional pivot bearing. This second pivot bearing 13, however, is already mounted in the housing 1 of the chain block and is situated behind the installation space 24, looking from the drive motor 2.

Figure 2:
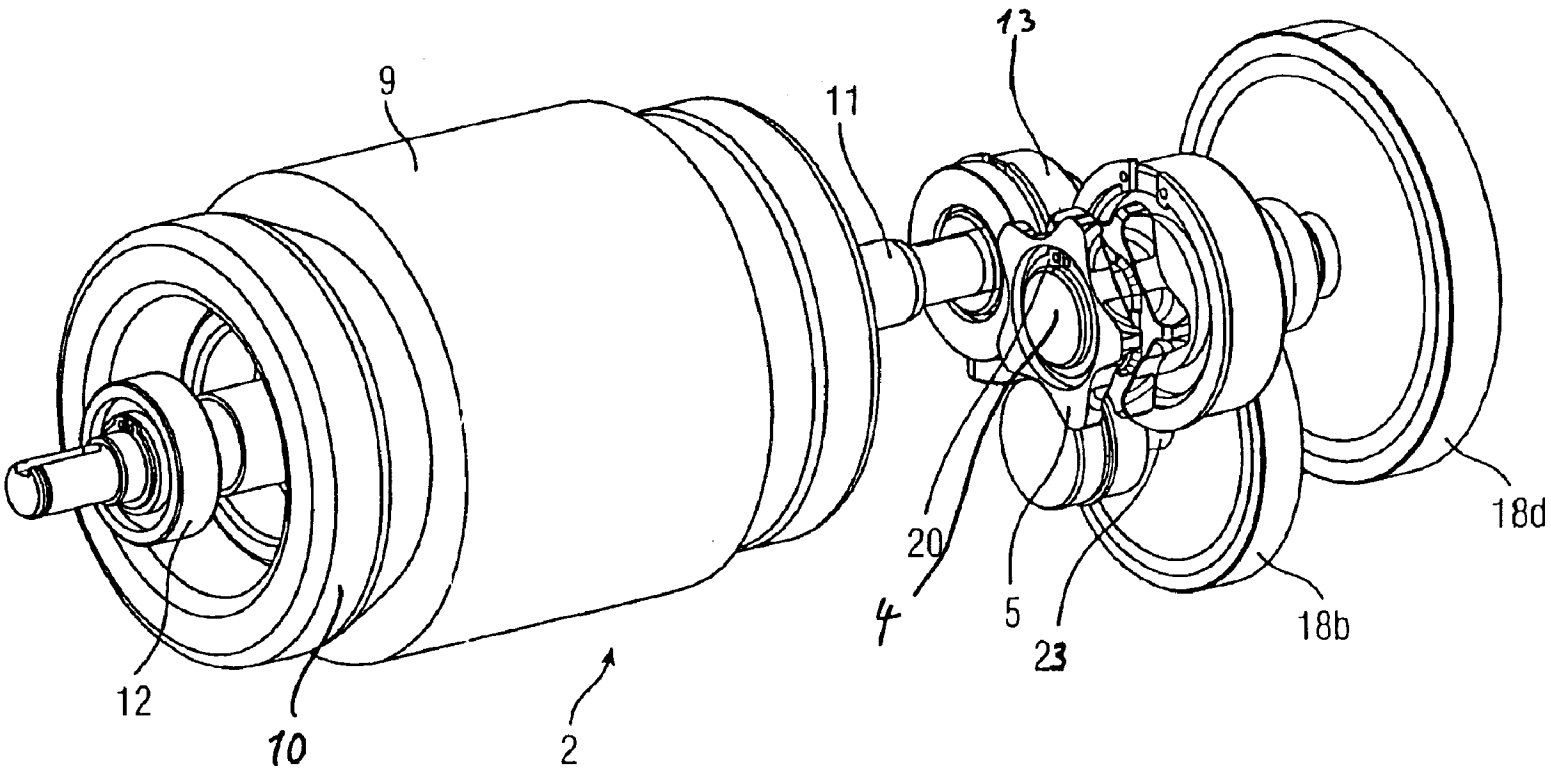
FIG. 2, a three-dimensional schematic representation of the chain block of FIG. 1.

FIG. 2 shows the elements of the chain block of FIG. 1 in a three-dimensional schematic representation. One notices that the transmission input shaft 14 and the transmission output shaft 4 together with the parallel middle drive shaft 23 form a V-shape, the transmission output shaft 4 being arranged somewhat above the motor shaft 11. This achieves a small structural width.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A chain block, comprising:

a drive motor and a transmission connected to the drive motor at a take-off side of said motor;

a chain wheel rigidly arranged on an output shaft of said transmission, said chain wheel for pulling a chain;

wherein said chain wheel faces said drive motor at an end face of said take-off and an outer circumference of said chain wheel reaching into an imaginary extension of an outer contour of the drive motor; and an installation space between said chain wheel and said end face of said drive motor, wherein a width of said installation space being the distance between said chain wheel and said end face is greater than the width of the chain wheel so that said chain wheel can be replaced without removing the drive motor.

2. The chain block of claim 1 wherein said outer circumference of the chain wheel reaches for at least a quarter of the diameter of the chain wheel into said imaginary extension of the outer contour of said drive motor.

3. The chain block of claim 1 wherein said end face of said drive motor is closed off from said installation space substantially solely by a sleeve of insulating plastic.

4. The chain block of claim 1 wherein said drive motor has a motor shaft that is oriented parallel to said transmission output shaft.

5. The chain block of claim 1 wherein said end face of said drive motor is closed off from said installation space substantially solely by a sleeve of insulating plastic.

6. The chain block of claim 1 wherein said end face of said drive motor is closed off from said installation space substantially solely by a sleeve of insulating plastic.

7. The chain block of claim 1 wherein said chain wheel can be pulled off from said transmission output shaft toward said end face after loosening a lock washer.

8. The chain block of claim 1 wherein a pay-out point of a chain from said chain wheel lies approximately at the center of gravity of the chain block.

9. The chain block of claim 1 wherein said chain block has a lug on a top side for suspension from a support element.

10. A chain block, comprising:

a drive motor and a transmission connected to the drive motor at a take-off side of said motor;

a chain wheel rigidly arranged on an output shaft of said transmission, said chain wheel for pulling a chain;

wherein said chain wheel faces said drive motor at an end face of said take-off and an outer circumference of said chain wheel reaching into an imaginary extension of an outer contour of the drive motor; and wherein said transmission has at least one first gear mounted on a transmission input shaft and at least one additional gear mounted on a transmission output shaft, wherein said transmission input shaft and said transmission output shaft are arranged at a distance from each other and run parallel to each other, and said motor shaft is arranged coaxially to said transmission input shaft.

11. The chain block of claim 10 wherein said transmission has two stages and, one of said stages comprising said transmission input shaft and said transmission output shaft, another of said stages comprising an additional transmission shaft, wherein said transmission input shaft, said transmission output shaft and said additional transmission shaft are arranged parallel to each other and in the shape of a V, while said transmission output shaft is generally arranged above said transmission input shaft and said motor shaft.

12. The chain block of claim 10 wherein said outer circumference of the chain wheel reaches for at least a quarter of the diameter of the chain wheel into said imaginary extension of the outer contour of said drive motor.

13. The chain block of claim 12 including an installation space between said chain wheel and said end face of said drive motor, wherein a width of said installation space being the distance between said chain wheel and said end face is greater than the width of the chain wheel so that said chain wheel can be replaced without removing the drive motor.

14. The chain block of claim 13 wherein said end face of said drive motor is closed off from said installation space substantially solely by a sleeve of insulating plastic.

15. The chain block of claim 10 wherein said drive motor has a motor shaft that is oriented parallel to said transmission output shaft.

16. The chain block of claim 15 including an installation space between said chain wheel and said end face of said drive motor, wherein a width of said installation space being the distance between said chain wheel and said end face is greater than the width of the chain wheel so that said chain wheel can be replaced without removing the drive motor.

17. The chain block of claim 16 wherein said end face of said drive motor is closed off from said installation space substantially solely by a sleeve of insulating plastic.

18. The chain block of claim 10 including an installation space between said chain wheel and said end face of said drive motor, wherein a width of said installation space being the distance between said chain wheel and said end face is greater than the width of the chain wheel so that said chain wheel can be replaced without removing the drive motor.

19. The chain block of claim 18 wherein said end face of said drive motor is closed off from said installation space substantially solely by a sleeve of insulating plastic.

20. The chain block of claim 10 wherein said chain wheel can be pulled off from said transmission output shaft toward said end face after loosening a lock washer.

21. The chain block of claim 10 wherein a pay-out point of a chain from said chain wheel lies approximately at the center of gravity of the chain block.

22. The chain block of claim 10 wherein said chain block has a lug on a top side for suspension from a support element.

* * * * *